United States Patent [19]

Acker

[11] 4,110,855

[45] Sep. 5, 1978

[54] CONVERTIBLE SOFA-BED UNIT

[75] Inventor: Donald J. Acker, Elkhart, Ind.

[73] Assignee: J.F. Enterprises, Inc., Wakarusa, Ind.

[21] Appl. No.: 831,606

[22] Filed: Sep. 8, 1977

[51] Int. Cl.[2] ..... A47C 17/00

[52] U.S. Cl. ..... 5/45; 5/59 R

[58] Field of Search ..... 5/13, 37 R, 44–46

[56] References Cited

U.S. PATENT DOCUMENTS

| | | | |
|---|---|---|---|
| 3,800,337 | 4/1974 | Mizelle | 5/45 |
| 3,858,255 | 1/1975 | Purves | 5/45 |
| 3,905,053 | 9/1975 | Vuchelich | 5/37 R |

*Primary Examiner*—Casmir A. Nunberg

*Attorney, Agent, or Firm*—Marmaduke A. Hobbs

[57] ABSTRACT

A convertible sofa-bed unit in which the back is moved from a substantially vertical position along the rear of the seat section to a horizontal position along the forward edge of the seat, and substantially on a plane therewith. The back is held in the two positions by a mechanism at each end, each consisting of two arms connected to the ends of the seat section and the back section which cause the back section to rotate to place the surface facing forward in the sofa position to the upwardly facing arrangement in the bed position. A support member is provided at each end of the seat section near the forward edge thereof for engagement by one arm at each end, capable of fully supporting the back in the bed position so that no legs are required for use of the unit as a double bed.

10 Claims, 6 Drawing Figures

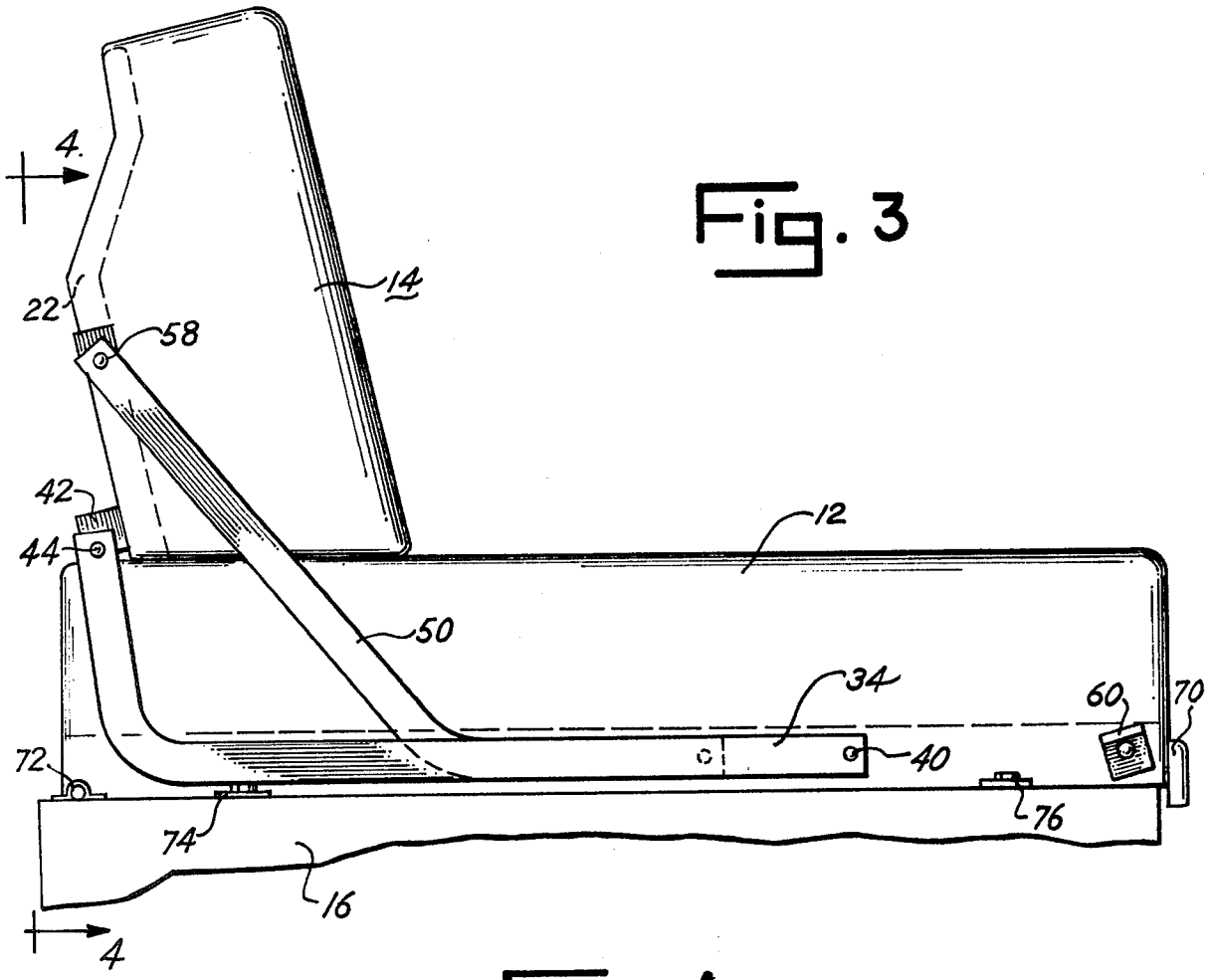
Fig. 3
Fig. 4
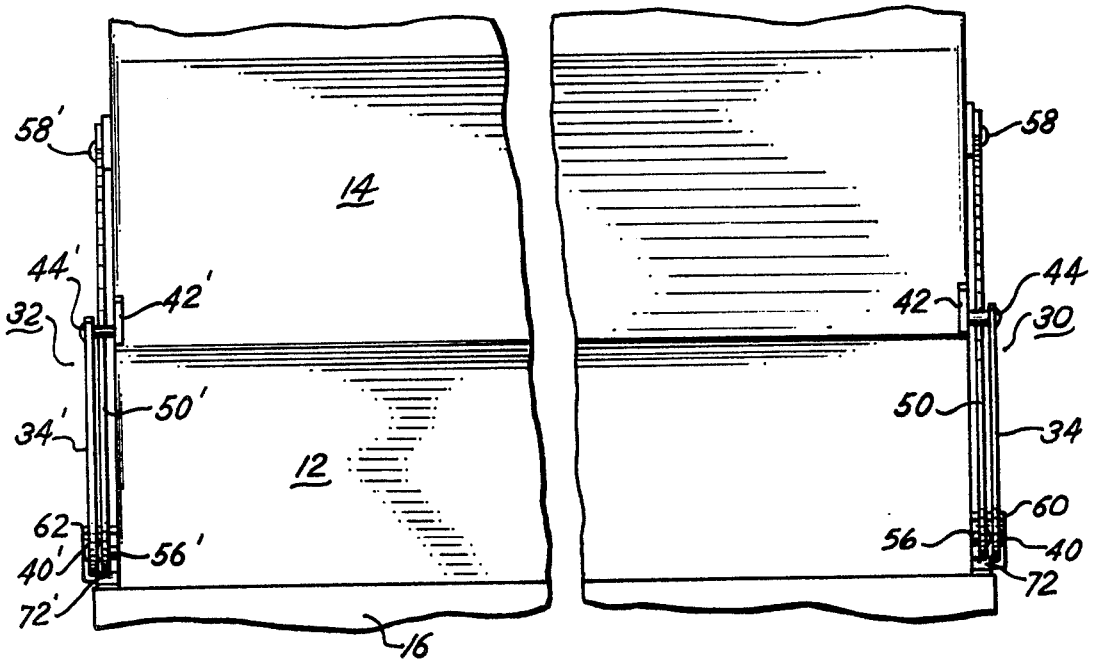

CONVERTIBLE SOFA-BED UNIT

Convertible sofa-beds have a variety of different types of operating mechanisms which either unfold the seat of the sofa to form one section of a double bed or lower the back from a substantially vertical position to a horizontal position to form a second horizontal section with the seat for the double bed. With most all past mechanisms for converting the sofa-bed between the two positions, either the basic frame structure must be moved away from the wall of the room in order to permit the unit to be converted to a bed, or a separate structure beneath the second section, such as one or more legs, is required to support the second section in its horizontal position. In places of limited space, such as in mobile or motor homes or in campers, legs and similar structures interfere with the folding and unfolding of the unit. Further, the legs or other supporting structure may require space beyond that required for the bed in order to move between the folded and unfolded position, and may require a firm, level and uniform floor on which to rest when in their unfolded position. Many of the prior sofa-beds include operating structures which will shift the unit between the two positions by a single movement, but the convertible characteristic is readily discernible from the outward appearance of the unit, thus detracting from the décor of the room. It is therefore one of the principal objects of the present invention to provide a convertible sofa-bed unit in which the back of the unit becomes the second section of a double bed without moving the basic frame of the unit, and in which the second section is fully supported in usable position as a portion of the bed without requiring legs or other supporting structure in contact with the floor.

Another object of the invention is to provide a convertible sofa-bed mechanism which rotates the back of the sofa from a position facing forwardly to a position facing upwardly in front of the seat section, as the back is pulled forwardly, and which supports the back section in its horizontal position as a bed without engaging the floor or other structure apart from the sofa-bed.

Still another object of the invention is to provide a mechanism for use in converting a sofa-bed unit between its two positions, which is relatively simple in construction and operation and can easily be installed in the units and operated merely by moving the back of the sofa between the two positions, and which is virtually inconspicuous and out of the way when the unit is in either its sofa position or its bed position.

A further object is to provide a convertible sofa-bed combination of the aforesaid type which includes an operating mechanism capable of being effectively operated with a variety of different types of upholstery and cushions without any appreciable modification, and which can readily be adapted for use in limited space, such as in motor and mobile homes, campers and other recreational vehicles.

Additional objects and advantages of the present invention will become apparent from the following description and accompanying drawings, wherein:

FIG. 3 is an end elevational view of the sofa-bed unit showing it in the sofa position;

FIG. 4 is a fragmentary rear elevational view of the sofa-bed unit shown in the preceding figures;

Figure 1:
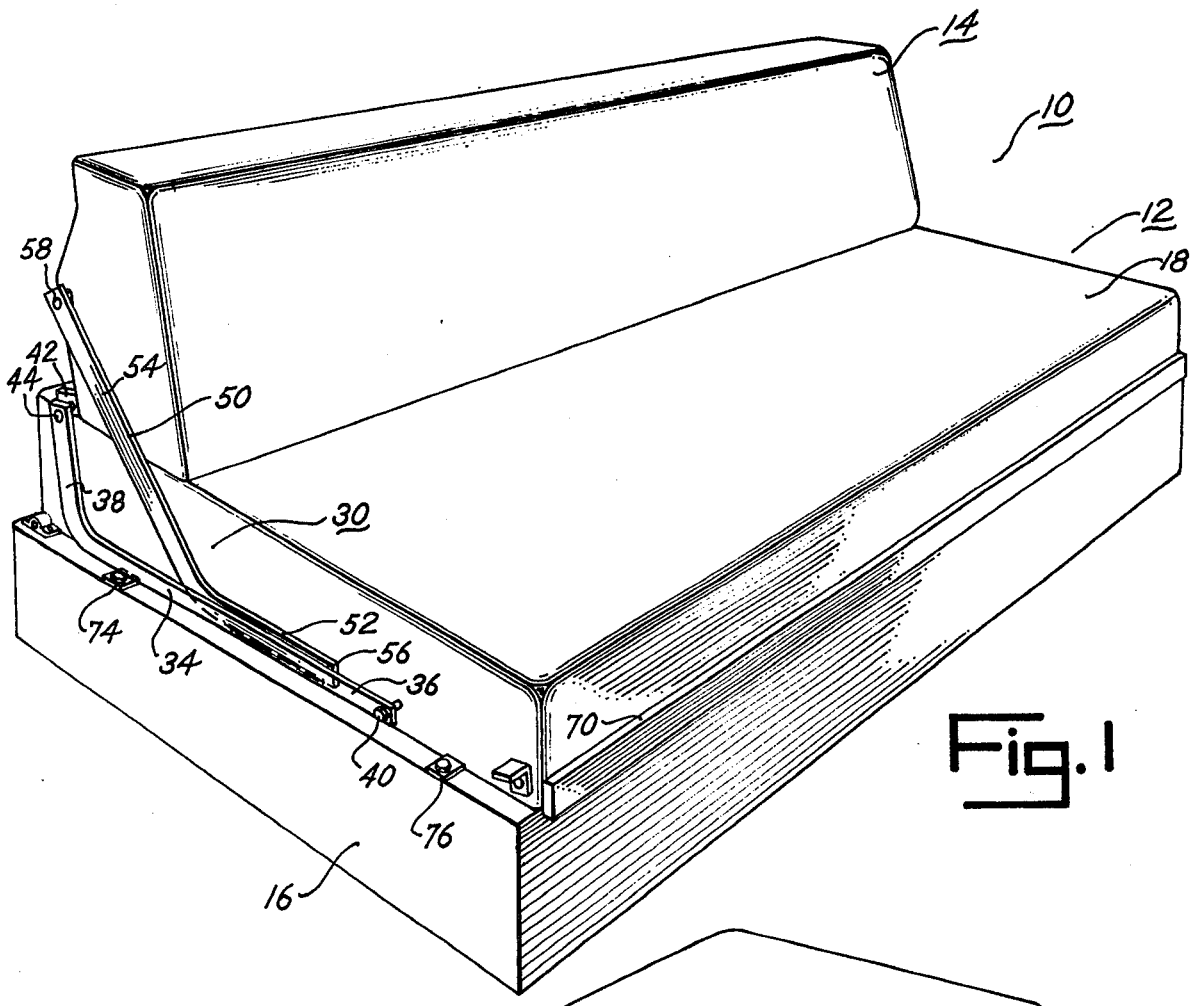
FIG. 1 is a perspective view of the present convertible sofa-bed unit showing it in the sofa position

Referring more specifically to the drawings, numeral 10 indicates generally the present sofa-bed unit, consisting of a seat section 12 and a back section 14, the seat section being shown mounted on a support or base 16 and including an upholstered cushion 18 in which a wood or metal frame 20 is enclosed. The frame 20 extends around the lower edge of the cushion and provides a rigid structure for the cushion. Various types of frame structures may be used, and the frame structure may form a part of the base 16 with a removable cushion supported thereby. A similar frame 22 is mounted in the rear of back section 14 to provide a rigid support for the back. In addition to the frame, the back section is primarily an elongated cushion of relatively firm construction.

Figure 2:
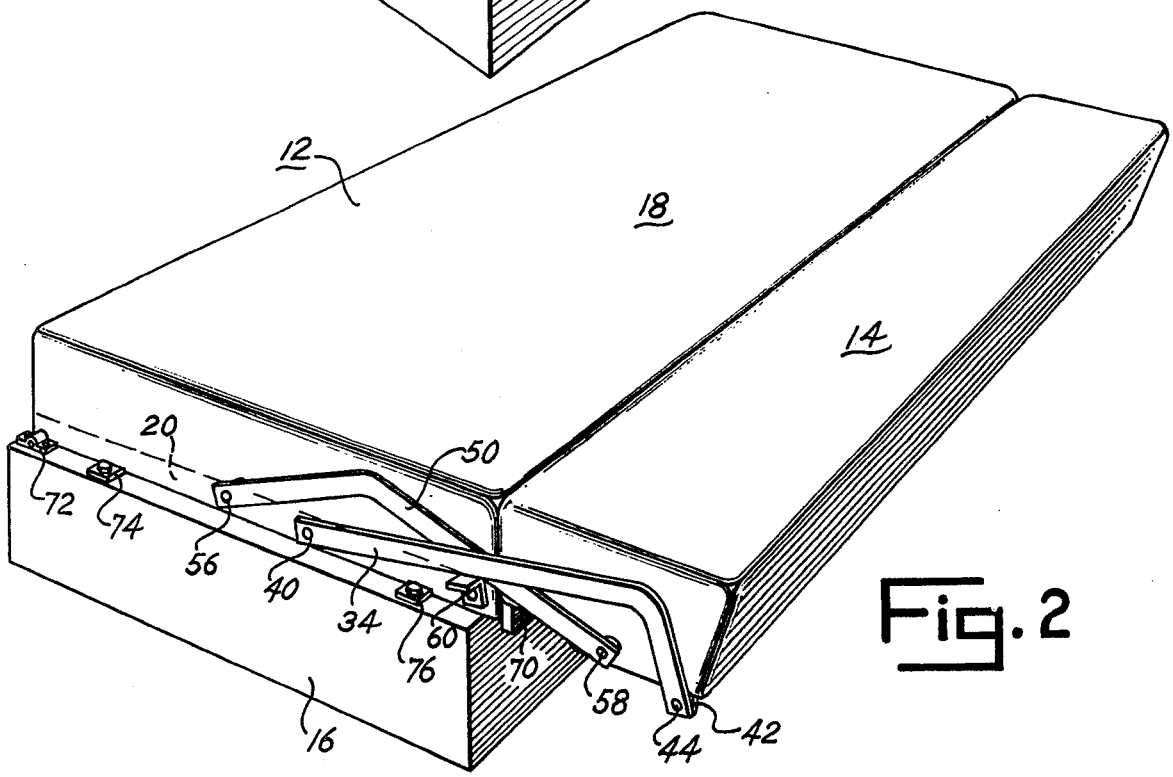
FIG. 2 is a perspective view of the convertible sofa-bed unit showing the unit in the bed position.
Figure 6:
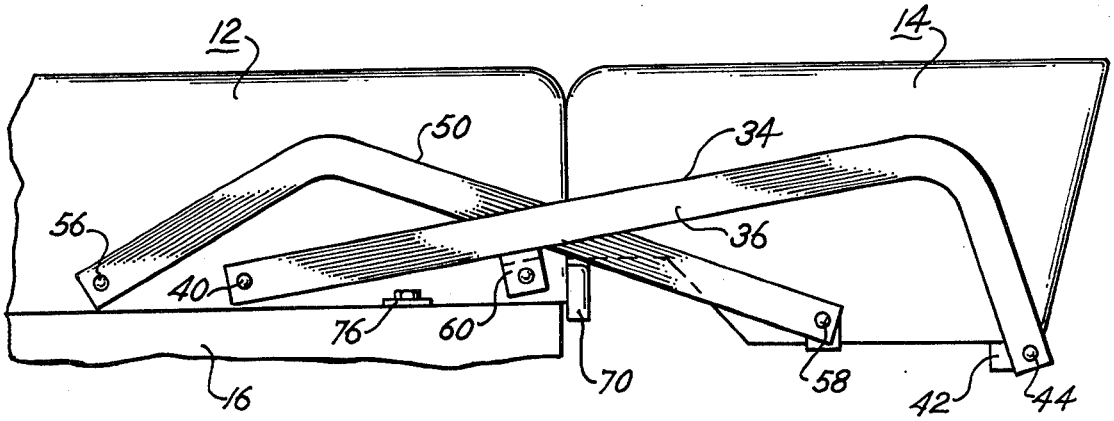
FIG. 6 is a fragmentary elevational view of the sofa-bed unit shown in its bed position.

The back rests on the seat cushion and is shifted between the sofa position shown in FIGS. 1, 3 and 4 to the bed position shown in FIGS. 2 and 6 by operating mechanisms 30 and 32 at opposite ends of the unit, the two operating mechanisms being essentially identical to one another with respect both to the construction, arrangement and operation. Hence, only one will be described in detail herein, with like numerals with primes identifying the respective parts on the other mechanism.

Mechanism 30 consists of an arm 34 having a generally horizontal member 36 and an upright member 38 joined integrally to member 36 at substantially a right angle, member 36 being connected to the frame or seat section 12 by a pin or screw 40 and to a bracket 42 secured to the frame 22 along the lower portion of back section 14 by a pin 44. A second arm 50 is provided, having a generally horizontal member 52 and a member 54 integrally joined to member 52 and extending angularly upwardly to the back, member 52 being pivotally secured to the frame of the seat section 12 by a pin 56 and to the frame of the back section by a pin 58 at a point above the upper end of arm 34. The description with reference to horizontal and vertical positions of the two arms as thus far used, has applied to the sofa-bed unit in the sofa position. The operating mechanisms 30 and 32 rotate the back section as it is pulled forward, in a single operation, from the position shown in FIG. 1 to the position shown in FIG. 2, in the manner best illustrated in FIG. 5 with the mechanisms providing full support for the back during the complete movement between the two positions.

When the foregoing operation from the sofa position to the bed position has been completed, the arms of the mechanisms are in a generally horizontal position. In this position members 36 and 36' of arms 34 and 34' are supported by brackets 60 and 62 secured to the frame in the seat section adjacent the respective forward corners. With arms 34 and 34' supported by brackets 60 and 62, the arms effectively support the forward edge of the back section when it is in the bed position, as illustrated in FIGS. 2 and 6. Arms 50 and 50' extend to a point approximately half-way between the forward and rearward edges of the back while the back section is in the bed position, to give additional support and stability to the back when it is in the bed position. In this position arms 50 and 50' may likewise be supported by brackets 60 and 62, respectively. To assure the proper positioning and effective support of the back section when it is in the bed position, a strip 70 forming an elongated bracket and preferably upholstered, is disposed along the lower front edge of the seat section and supports the rear edge of the back when the back is in the bed position, so that the upper surface of the back, when in this position, is effectively maintained on a plane with the upper surface of the cushion of the seat section. With the two arms at each end in the position shown in FIGS. 2 and 6 and with arms 34 and 34' being supported by brackets 60 and 62 and the back section being supported by bracket 70, the back section is retained in its horizontal bed position without the need for any further support such as legs extending downwardly from the back to the floor. This structure permits the bed to be used in a limited space without legs or other additional support means which could interfere with the folding and unfolding of the bed, and without the necessity of providing a floor or other uniform supporting structure beneath the back section while it is in the bed position. However, in some instances where a wall or other permanent structural features are in close proximity to the back when it is in the bed position, a bracket or a fixture may be provided on the structural features for providing additional support for the back section.

As shown in the drawings, the seat section, including the cushion and the rigid frame therein, is supported on a base 16 which, in the embodiment illustrated, consists essentially of four timbers or other structural members forming a rectangular structure on which the seat section is mounted. In order to permit the base to be used for storage space such as for pillows, blankets and other bed clothing, the seat section is attached to base 16 by hinges 72 and 72' at the ends of the seat section so that the front side of the seat section can be tilted upwardly to permit access to the space in the base. While the seat section may rest on the upper edge of the base, it may be partially recessed in the base and supported by fixtures 74 and 76 at each end of the base.

Figure 5:
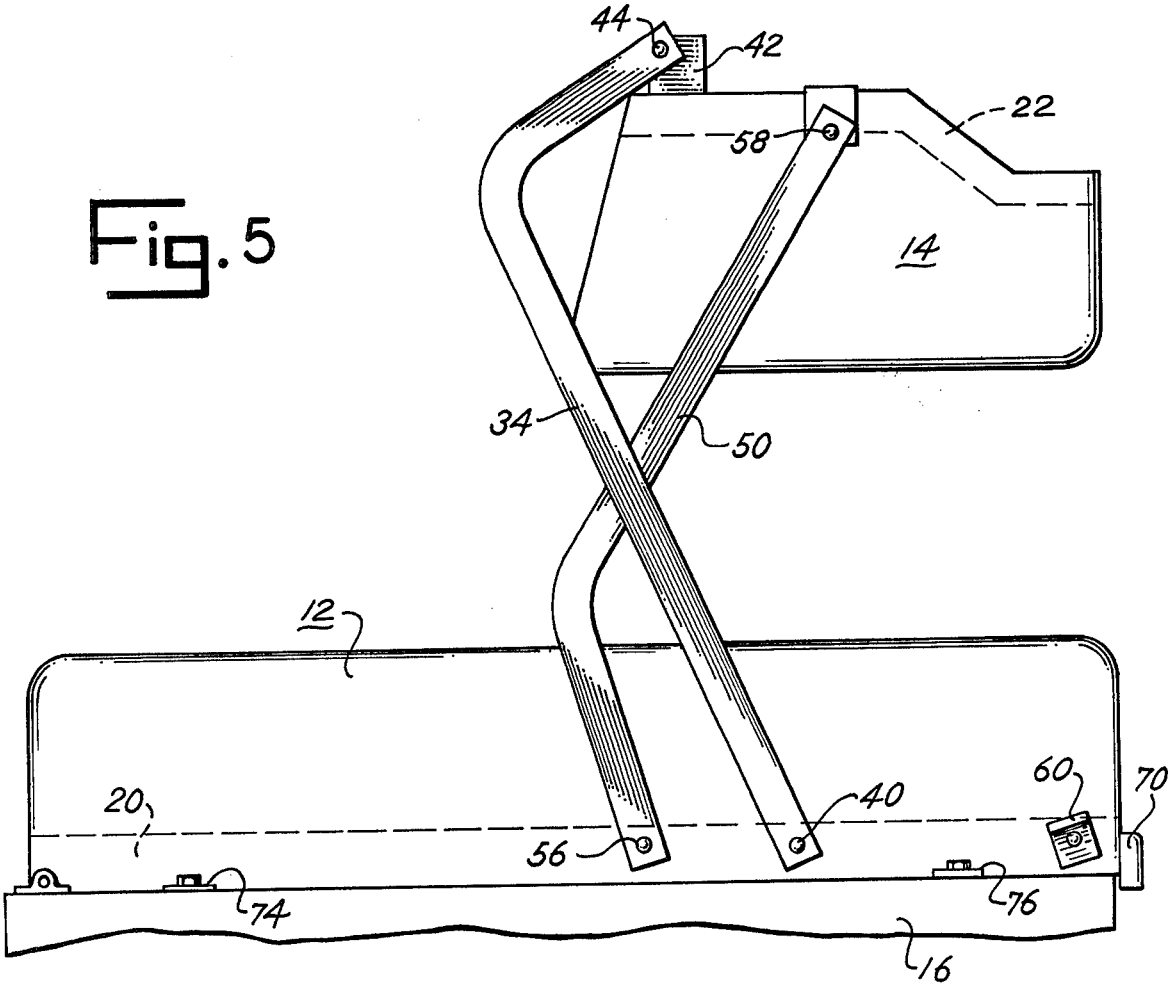
FIG. 5 is an end elevational view showing the manner in which the sofa-bed unit is converted between the two positions.

In the operation of the present convertible sofa-bed unit, to convert the unit between the two positions, starting with the units in the position shown in FIG. 1, back section 14 is pulled forwardly, and, under the control of mechanisms 30 and 32, the back section is rotated in a clockwise direction as seen in FIG. 5, from the position at which the front of the back section faces forwardly to a position where the front faces upwardly as seen in FIG. 2. When the unit is in the bed position, arms 34 and 50 engage bracket 60, and arms 34' and 50' engage bracket 62, and the rear edge of the back section engages bracket 70, as the back section reaches its horizontal position in front of the seat section. Thus a firm support is provided for the back section when it is in the bed position without the need for any additional support such as legs beneath the back. The sofa-bed unit is now sufficiently large that two adults can sleep comfortably on the unit. When the unit is to be returned to its sofa position, the back is merely lifted and, as it is pushed backward, it automatically rotates in a counterclockwise direction, as seen in FIG. 6, to place the back section in the position shown in FIGS. 1 and 3, with the back section being firmly supported by the seat section and being held in its substantially vertical position by arms 50 and 50'. The forward end of the seat section can be lifted to gain access to the compartment in base 16 in either the sofa or bed position by merely lifting the forward edge of the seat section, rotating the seat section on hinges 72 at the rear of the base and seat section. Since the seat section is secured to the base at the rear corners, the overhang of the back section when in the bed position is given sufficient stability to effectively support the weight of an adult person on the back section without resulting in tilting of the bed.

It is seen that an efficient space saving convertible sofa-bed unit has been provided by the foregoing structure which can be used effectively in limited spaces, such as often encountered in motor and mobile homes, campers and cabin cruisers. The seat section can be rigidly mounted on a support or a different type of base so long as a firm and stable support is provided for the seat section. The base may be secured to the structure of the motor or mobile home or other vehicle in which it is used.

While several modifications have been mentioned herein, various other changes and modifications may be made in the present convertible sofa-bed unit without departing from the scope of the invention.

I claim:

1. A convertible sofa-bed unit comprising an elongated, horizontal seat section having a supporting frame for a seat, a back section being substantially the same length as said seat section and positioned vertically upwardly from the rear of said seat section and being movable from said position to a horizontal position along the forward edge of said seat section, an operating mechanism at each end of said sections interconnecting said sections, each mechanism including a first arm having a member in a generally horizontal position pivotally connected to the end of said seat section toward the forward edge thereof and a member in a generally vertical position rigidly connected at one end to the rear end of said first member and pivotally connected at the other end to the lower portion of the respective end of said back section, a second arm connected at one end to the end of said seat section rearwardly from the connection between the seat section and said first arm and at the other end to the back section above the connection between said back section and said first arm, said arms pivoting forwardly with said back section to a position at which said arms are in a generally horizontal position, and a support means for said first arm connected to the frame of said seat section near the forward edge thereof for supporting said back section in a horizontal position along the forward edge of said seat section, with said first arm in contact with said support means and with said pivotal connection of said first arm and said back section being disposed forwardly of the pivotal connection of said second arm and said back section.

2. A convertible sofa-bed unit as defined in claim 1 in which the members of said first arm are at substantially right angles to one another.

3. A convertible sofa-bed unit as defined in claim 1 in which said second arm has two members joined integrally to one another in an angular relationship, one of said angular members being disposed in generally horizontal position when the unit is in the sofa position and the other of said members extending upwardly to a point on said back section spaced from the bottom thereof.

4. A convertible sofa-bed unit as defined in claim 1 in which said second arm is disposed inwardly from said first arm and extends over the connection between said first arm and said seat section when said unit is in the bed position.

5. A convertible sofa-bed unit as defined in claim 2 in which said second arm is disposed inwardly from said first arm and has two members joined together integrally to one another in an angular relationship, one of said angular members being disposed in generally horizontal position when the unit is in the sofa position and the other of said members extending upwardly to a point on said back section spaced from the bottom thereof.

6. A convertible sofa-bed unit as defined in claim 1 in which said arms are rigid metal bars and each is pivotally connected at opposite ends to the seat and back section.

7. A convertible sofa-bed unit as defined in claim 1 in which said support means for said first arm disposed on the seat portion near the forward edge thereof is rigidly secured to said seat section and fully supports the forward edge of said back section when said back section is in the bed position.

8. A convertible sofa-bed unit as defined in claim 5 in which said support means for said first arm disposed on the seat portion near the forward edge thereof is rigidly secured to said seat section and fully supports the forward edge of said back section when said back section is in the bed position.

9. A convertible sofa-bed unit as defined in claim 1 in which a means is provided along the forward edge of said seat section for supporting the adjacent edge of said back section when said back section is in the bed position.

10. A convertible sofa-bed unit as defined in claim 5 in which a means is provided along the forward edge of said seat section for supporting the adjacent edge of said back section when said back section is in the bed position.

* * * * *